United States Patent [19]

Akiike et al.

[11] Patent Number: 4,908,594

[45] Date of Patent: Mar. 13, 1990

[54] THERMAL OVERLOAD RELAY

[75] Inventors: Katsumi Akiike; Haruo Ichikawa, both of Kanagawa, Japan

[73] Assignee: Fuji Electric Co., Ltd., Kanagawa, Japan

[21] Appl. No.: 215,854

[22] Filed: Jul. 6, 1988

[30] Foreign Application Priority Data

Jul. 14, 1987 [JP] Japan ..... 62-175333
Sep. 9, 1987 [JP] Japan ..... 62-137676[U]

[51] Int. Cl.[4] ..... H01H 71/16
[52] U.S. Cl. ..... 337/49; 337/45
[58] Field of Search ..... 337/49, 48, 45, 46

[56] References Cited

U.S. PATENT DOCUMENTS 4,652,847 3/1987 Sako ..... 337/49

*Primary Examiner*—H. Broome
*Attorney, Agent, or Firm*—Finnegan, Henderson, Farabow, Garrett and Dunner

[57] ABSTRACT

A thermal overload relay comprising a change-over spring mechanism and a contact mechanism that is separated from the spring mechanism. The contact mechanism is actuated by the spring mechanism, which is driven by a bimetallic strip when an overcurrent flows through the strip. The spring mechanism has no electrically conducting portion. The change-over point of the spring mechanism varies only a little, thus enhancing the reliability. The spring mechanism is easy to assemble and adjust.

11 Claims, 4 Drawing Sheets

THERMAL OVERLOAD RELAY

FIELD OF THE INVENTION

The present invention relates to a thermal overload relay and, more particularly, to a change-over mechanism and a contact medium of such a relay.

BACKGROUND OF THE INVENTION

The known thermal over load relays are shown in FIGS. 7 and 8. The relay shown in FIG. 7 has a bimetallic strip 1, which buckles when an overcurrent flows through it. A shifter 2 that interlocks with the strip 1 moves to the left as viewed in the figure and pushes a release lever 3 to the left when the bimetallic strip buckles. Then, the release lever 3 rotates clockwise around the support pin 3*a* so that a protrusion 3*b* at the upper end of a release lever 3 is disengaged from an eccentric disk 9*a* connected to a set button 9. This makes the release lever 3 be pushed upward by a spring S. A projection 3*c* formed on the release lever 3 is pressed against a claw 5*a* attached to a movable plate 5 to angularly move the plate 5 in a counterclockwise direction about a groove 8*a* formed in a terminal 8. The movable contact 6 of the movable plate 5 then breaks contact with a normally-connected fixed contact 4 and makes contact with a normally-disconnected fixed contact 7. The movable plate 5 is urged into the groove 8*a* by a spring (not shown), so that it is electrically connected with the terminal 8. After the overcurrent is removed, by depressing a reset rod 10, a reset pin 10*a* pushes down the release lever 3 to disengage the projection 3*c* on the lever 3 from the claw 5*a* on the movable plate 5. The spring (not shown) rotates the movable plate 5 in a clockwise direction about the groove 8*a* until the protrusion 3*b* on the lever 3 engages the eccentric disk 9*a*. Thus, the reset operation is completed.

FIG. 8 schematically shows a change-over mechanism of another known relay. This relay includes a bimetallic strip 16 and a shifter 17. When the strip 16 buckles to move the shifter 17 to the left as viewed in the figure, the shifter 17 rotates a release lever 18 in a clockwise direction about a pivot X via a temperature-compensating bimetallic strip 18*b*. The free end of the lever 18 is in contact with a tension spring 14 that has an end engaged in a groove 15*a* formed in a terminal board 15. The other end of the spring 14 is fixed to a movable plate 11. When the free end of the lever 18 pushes the tension spring 14 past the position of the groove 15*b* in the terminal board 15 about which the movable plate 11 rotates, the movable plate 11 is quickly turned by the action of the tension spring 14. The movable contact point 12 of the movable contact 11 moves away from a normally connected fixed contact 13 and comes into contact with a normally-disconnected fixed contact (not shown).

In these conventional relays, the movable plates 5 and 11 are connected to the terminal boards 8 and 15, respectively. When electric wires are connected to the terminal boards 8 and 15, the tightening forces of terminal screws (not shown) may bring the grooves 8*a* and 15*a* out of position. If such a deviation occurs at 11, the change-over points of the boards shift to cause a change in the values of the operating current flowing through the thermal overload relays. Therefore, whenever electric wires are connected, it is necessary to readjust the movable and fixed contacts. These operations are cumbersome to perform and require a long time.

SUMMARY OF THE INVENTION

An object of the present invention is a thermal overload relay that is free of the difficulties of conventional relays and can be assembled in such an efficient manner as automatic assembling.

Another object of the present invention is a thermal overload relay having operating characteristics that are prevented from varying when the electrical wires are connected.

A further object of the present invention is a thermal overload relay that can be assembled efficiently and has an easily adjustable change-over point.

These and other objects are achieved by a thermal overload relay comprising a bimetallic strip that buckles when an overcurrent flows therethrough, a release lever having one end engaging a shifter and which is rotated by the bimetallic strip via the shifter when the strip buckles, a spring mechanism consisting of a first spring engaging the other end of the release lever and a second spring that is responsive to the first spring changing out of a first stable state past a dead point by the rotation of the release lever, to bring the first spring into a second stable state, and a contact mechanism having a contact support engaging a free end of the spring mechanism for making or breaking a circuit when the first spring is brought into the first or second stable state.

In the thermal overload relay constructed in this way, the free end of the change-over spring mechanism engages the contact mechanism. That is, these elements are fabricated independently of each other and, therefore, the spring mechanism is not affected by the external force that is applied when electric wires are connected. It is easy to assemble and adjust the relay. Further, the reliability of the operating characteristics is enhanced.

A second embodiment of a thermal overload relay comprises a bimetallic strip that buckles when an overcurrent flows therethrough, a release lever having one end engaging a shifter and being rotated by the bimetallic strip via the shifter when the strip buckles, a spring mechanism including a first spring engaging with the other end of the release lever and a second spring responsive to the changing of the first spring out of a first stable state and beyond a dead point thereof by the rotation of the release lever, to move the first spring into a second stable state, a change-over point adjusting device rigidly fixed to the pivotal point of the spring mechanism and mounted so as to be swingable, the adjusting device including an adjusting screw that moves forward and rearward to move the dead point of the spring mechanism and a contact mechanism engaging with the free end of the first spring and having movable contacts for making or breaking contact with corresponding fixed contacts by a change over of the spring mechanism.

In this relay, the change-over spring mechanism engages the contact mechanism at a free end. That is, they are fabricated independently of each other. The spring mechanism is equipped with the change over point-adjusting device Therefore, the spring mechanism is not affected by the external force that is applied when electric wires are connected. It is easy to assemble and adjust the relay. Also, the reliability of the operating characteristics is enhanced.

BRIEF DESCRIPTION OF THE DRAWINGS

The manner by which the above objects and other objects, features, and advantages of the present invention are attained will be fully apparent form the following detailed description when considered in view of the drawings wherein.

DETAILED DESCRIPTION OF THE INVENTION

Figure 2:
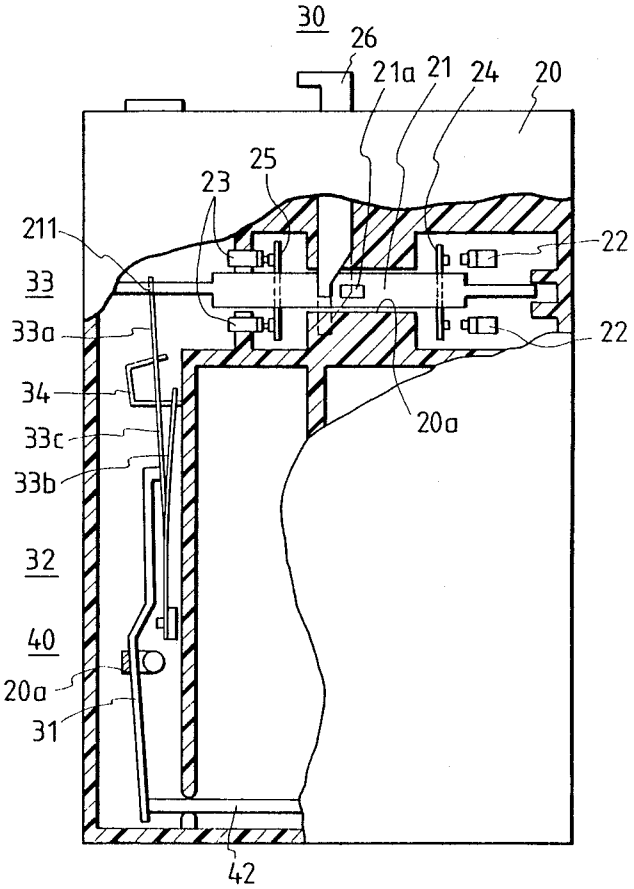
FIG. 2 is a view similar to FIG. 1, but in which the relay has been actuated.
Figure 1:
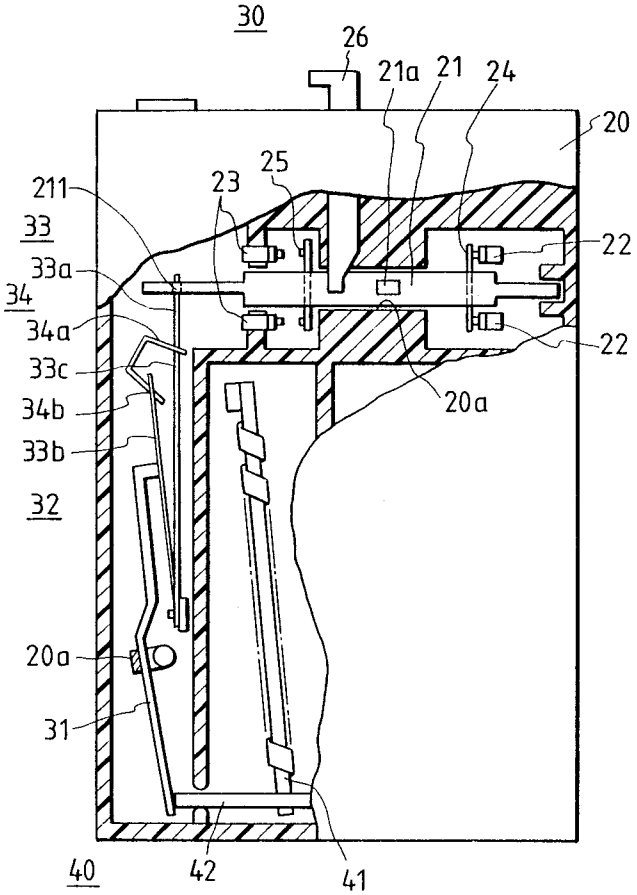
FIG. 1 is a partial cross-sectional view of a thermal overload relay according to the present invention, when the relay is not actuated.

Referring in FIGS. 1 and 2, there is shown a thermal overload relay embodying the present invention. This relay includes a contact mechanism 30 and, a change-over mechanism 40. The contact mechanism 30 has a movable contact support 21. The change-over mechanism 40 includes a first spring 33 for change-over having a free end on its long leg 33*a*. This relay differs most significantly from the conventional relays in that the contact mechanism 30 is independent of the change-over mechanism 40, and only the contact support 21 and the free end on the long leg 33*a* engage the contact mechanism 30 and the change-over mechanism 40. There, the change-over mechanism 40, has neither energizing contacts nor conductors.

More specifically, the contact mechanism 30 is located in a high position inside an insulating case 20, and comprises the movable contact support 21, normally connected fixed contacts 22, normally disconnected fixed contacts 23, a normally connected movable contact 24, a normally disconnected movable contact 25, and a restoring rod 26. The support 21 is inserted in a groove 20*a* formed in the case 20 so as to be slidable axially, and has a coupling hole 211 at one end. The contacts 22, 23, 24, and 25 are also disposed inside the case 20. The fixed contacts 22 can be connected together by the movable contact 24. The movable contact 25 can connect together the fixed contacts 23. The restoring rod 26 is inserted in the case 20 to engage the contact support 21. After the relay has been actuated, the rod 26 returns the contact mechanism to its original position.

The change-over mechanism 40 consists of a release lever 31 and a spring mechanism 32. One end of the lever 31 engages with a shifter 42 that interlocks with an end of a bimetallic strip 41. The lever 31 is swingably mounted to a seesaw mount 20*a* fixed to the insulating case 20. The spring mechanism 32 member is engaged at an end in the coupling hole 211 in the contact mechanism 30. When the release lever 31 rotates the spring mechanism beyond its dead point, the spring mechanism 32 springs back.

The spring mechanism 32 includes a first spring 33 and a second spring 34. The first spring 33 is made from a strip of material adapted for springs, and forms a long leg 33*a* and a short leg 33*b*. The short leg 33*b* is fabricated by cutting and raising the central portion of the strip. Each leg has a free end. The long leg 33*a* has an opening 33*c* through which the short leg 33*b* can pass. The second spring 34 is shaped like the letter "U", and has side legs 34*a* and 34*b*. The side leg 34*a* is resiliently attached to the edge of the opening 33*c* in the first spring 33 and is bendable at the attached location The side leg 34*b* is resiliently attached to the end of the short leg 33*b* and is bendable at the attached location When the release lever 31 is rotated in a clockwise direction by the shifter 42 due to the buckling of the bimetallic strip 41, the other end of the spring mechanism 32 pushes the short leg 33*b* which then passes beyond the dead point, i.e., passes through the opening 33*c*. The movement of the second spring 34 causes the long leg 33*a* to spring back which, as shown in FIG. 2, causes the movable contact 24 to disengage from the fixed contacts 22, and the movable contact 25 to engage the fixed contacts 23. The relay may be restored to its original condition by pushing the restoring rod 26 downward to cause a protruding portion 21*a* to move the movable contact support 21 to the right as viewed in the figure, and the first spring 33 to spring back. Thus, the condition shown in FIG. 1 is regained.

In the structure described above, the contact mechanism 30 and the change-over mechanism 40 can be assembled independently of each other. Therefore, the change-over mechanism 40 has no electrically conducting portion, and a terminal connected with an electric wire is not needed to be provided with the change-over mechanism 40. For these reasons, when electric wires are connected with the contact mechanism 30, the change-over mechanism 40 can be set in position without being affected by any external force applied to wiring. Further, this setting operation is easy to perform and can be readily automated.

The spring mechanism 32, which depends on the delicate engagement between the components, possesses no electrically conduction portion and, therefore, the first and second springs 33, 34 are not required to be made of any special material to secure the requisite performance, as electric conductors as well as springs, but can be made of an inexpensive leaf spring material. In this way, the change-over mechanism 40, which only acts to apply a driving force to the contact mechanism 30, is separated from the contact mechanism 30. When electric wires are connected to the contact mechanism, no external force is exerted on the change-over mechanism 40. This makes it unnecessary to rigidly fix the mechanism. Hence, it is simple in structure and can be assembled easily. In addition, the change-over mechanism 40 can be made of an inexpensive material, since it is not electrically energized.

Figure 4:
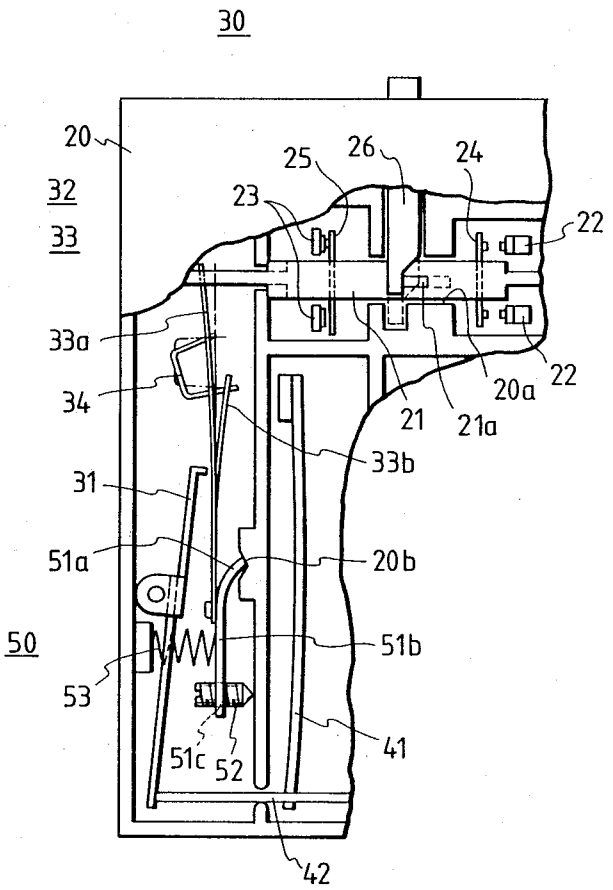
FIG. 4 is a view similar to FIG. 3, but in which the relay has been actuated.
Figure 3:
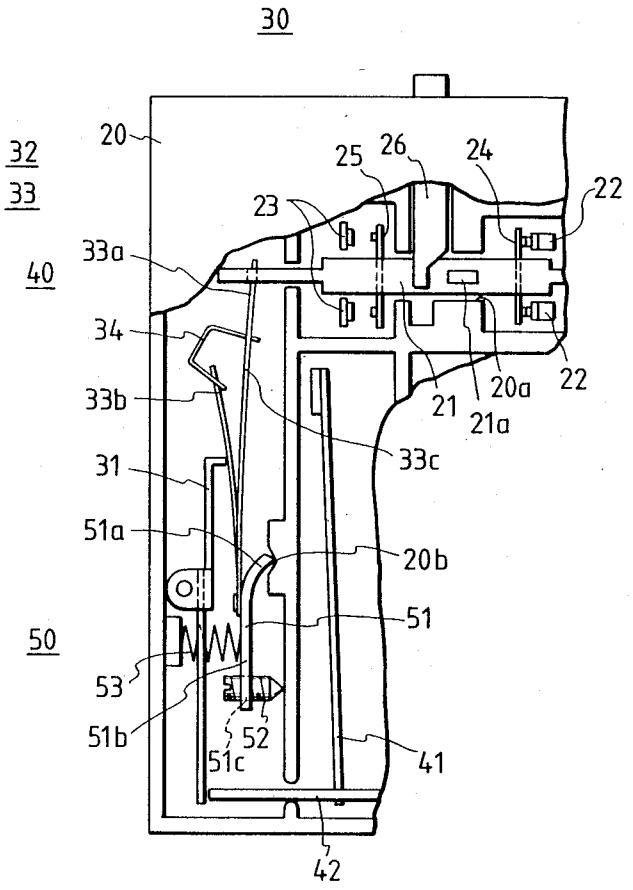
FIG. 3 is a partially cutaway front elevational view of another thermal overload relay according to the present invention, when the relay is not actuated.

Referring next to FIGS. 3 and 4, there is shown another embodiment of a thermal overload relay according to the present invention. This relay is similar to the relay shown in FIGS. 1 and 2 except that the change-over mechanism 40 is equipped with a change-over point-adjusting device 50 comprising a support member 51, an adjusting screw 52, and a compression spring 53. The support member 51 has a bent short leg 51*a* and a long leg 51*b* to which the pivotal point of the first spring 33 is rigidly fixed. The end of the short leg 51*a* forms a knife edge, and the leg 51*a* is swingably engaged in a V-shaped groove 20*b* which is provided on a wall formed inside the case 20. The long leg 51*b* has a threaded hole 51*c* in which the screw 52 is inserted so as to be movable forward and backward. The spring 53 is resiliently mounted between the intermediate portion of the long leg 51*b* and the inner wall of the case 20.

Figure 5:
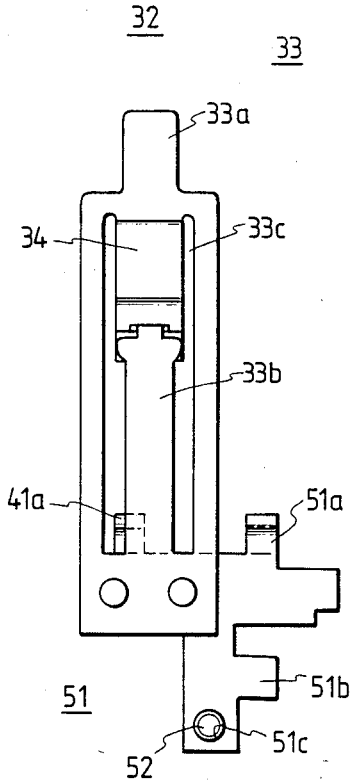
FIG. 5 is a plan view of the main components of the relay shown in FIGS. 3 and 4.
Figure 6:
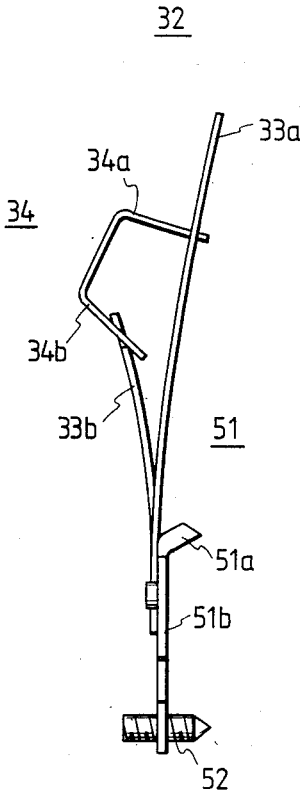
FIG. 6 is a side elevation of the components shown in FIG. 5.
Figure 8:
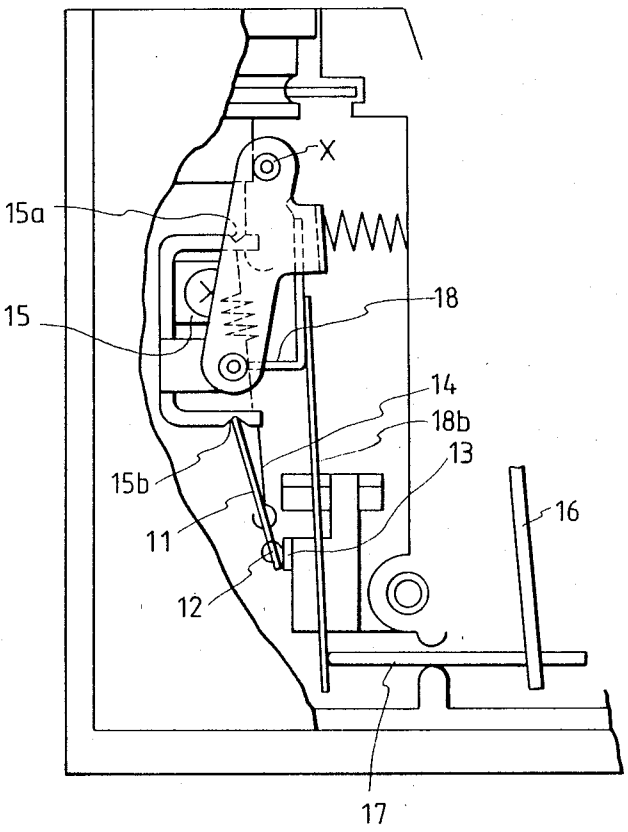
FIG. 8 PRIOR ART
FIG. 7 and 8 are partially cutaway front elevations of conventional thermal overload relays.
Figure 7:
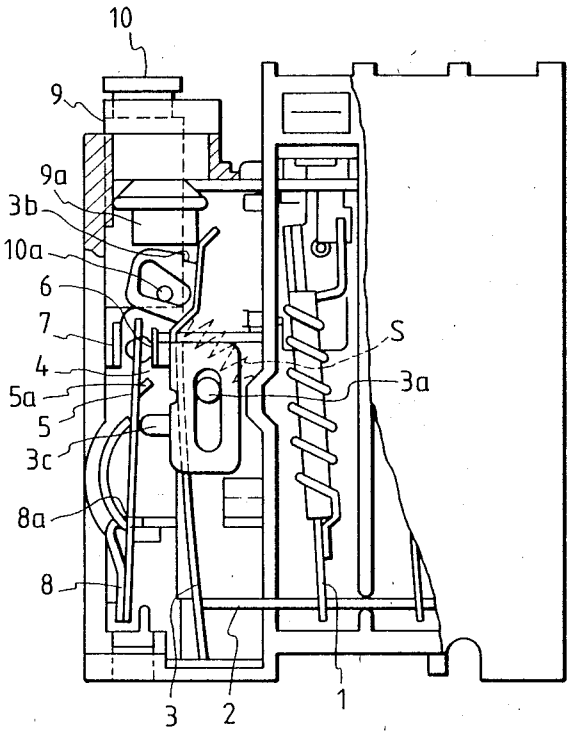
FIG. 7 PRIOR ART

The spring mechanism 32 is now described in more detail by referring to FIGS. 5 and 6. This mechanism is composed of a first spring 33 and a second spring 34. The first spring 33 consists of a strip of leaf spring material. The central portion of the strip is cut and raised to form a short leg 33*b* and the rest of the strip forms a long leg 33*a*. Each leg has a free end. The long leg 33*a* has an opening 33*c* through which the short leg 33*b* can pass. The second spring 34 is shaped like the letter "U", and comprises side legs 34*a* and 34*b*. The legs 34*a* and 34*b* are resiliently mounted at an edge of the opening 33*c* of the first spring 33 and the end of the short leg 33*b*, respectively, so as to be bendable at the mounted locations.

When the release lever 31 is rotated clockwise by the shifter 42 upon the buckling of the bimetallic strip, the other end of the level pushes the short leg 33*b* and causes it to pass beyond its dead point. In so doing, the end of the short leg 33*b* passes through the opening 33*c*. Then, the long leg 33*a* is caused to spring back by the second spring 34 and pulls the movable contact support to the leftward. Consequently the movable contact 24 of the contact mechanism 30 moves away from the fixed contacts 22, while the movable contact 25 makes contact with the fixed contacts 23, as shown in FIG. 4. To restore the original state, the restoring rod 26 is pushed downwardly. Then, the protruding portion 21*a* on the movable contact support 21 is moved to the right as indicated by the broken line in FIG. 4. The first spring 33 moves past the dead point to its original position. Thus, the condition shown in FIG. 3 is regained.

The change-over point can be accurately adjusted by the change-over point-adjusting device 50. When the adjusting screw 52 is rotated by a screw driver, the whole spring mechanism 32 is rotated until the driving force is balanced by the force of the compression spring 53. Consequently,the change-over point can be varied continuously.

In one embodiment of the present invention, the change-over mechanism and the contact mechanism are separated from each other. The change-over mechanism has no electrically conduction portion and no force for wiring is applied to it. Therefore, the operating characteristics of the change-over mechanism do not vary when electric wires are connected to the relay. Also, the thermal overload relay is easy to assemble and adjust.

In another embodiment of the invention, the change-over mechanism equipped with the change-over point-adjusting device is also separated from the contact mechanism, and has no electrically conducting portion. Therefore, when electrical wires are connected, the operating characteristics do not change. Further, the assembly operation, including the adjustment of the change-over point, is easy to perform.

What is claimed is:

1. A thermal overload relay comprising:

a. a bimetallic strip adapted to be deformed when an overcurrent flows therethrough;

b. a change-over mechanism comprising:

a shifter connected to an end of said bimetallic strip to be shifted thereby upon deformation of said bimetallic strip, a rotatable release lever having a first end and a second end, said first end contacting said shifter to rotate said release lever in response to said shifting of said shifter; and a spring mechanism having a first spring for engaging said second end of said release lever and a second spring, said first spring having a first stable state, a second stable state, and a free end, said second spring for moving said first spring from said first stable state to said second stable state in response to rotation of said release lever; and c. a contact mechanism including a contact support engaged with said free end of said first spring for establishing a first contact condition when said first spring is in said first stable state and a second contact condition when said first spring is in said second stable state, wherein said change-over mechanism and said contact mechanism are assembled independently and said change-over mechanism possesses no electrically conductive portion in either said first stable state or said second stable state.

2. A thermal overload relay according to claim 1, wherein said first spring includes a first leg including said free end, a second leg for contacting said release lever, and a opening for enabling said second leg to pass through said first leg upon rotation of said release lever to move said first spring from said first stable state to said second stable state.

3. A thermal overload relay according to claim 2, wherein said second spring includes a first side member having an end attached to said second spring and a second side member attached to said first spring to pass the dead point thereof as said first spring moves from said first stable state to said second stable state.

4. A thermal overload relay according to claim 3, wherein said contact mechanism includes:

a first set of fixed contacts;

a second set of fixed contacts;

a first set of movable contacts mounted on said contact support for contacting said first set of fixed contacts when said first spring is in said first stable state; and a second set of movable contacts mounted on said contact support for contacting said second set of fixed contacts when said first spring is in said second stable state.

5. A thermal overload relay according to claim 4, further including a restoring rod connected to said contact support, said restoring rod when activated for moving said contact support to contact said first set of fixed contacts and said second set of fixed contacts and for moving said first spring from said second stable state to said first stable state.

6. A thermal overload relay comprising:

a. a bimetallic strip adapted to be deformed when an overcurrent flows therethrough;

b. a change-over mechanism comprising:

a shifter connected to an end of said bimetallic strip to be shifted thereby upon deformation of said bimetallic strip, a rotatable release lever having a first end and a second end, said first end contacting said shifter to rotate said release lever in response to said shifting of said shifter, and a spring mechanism having a first spring for engaging said second end of said release lever and a second spring, said first spring having a first stable state, a second stable state, and a free end, said second spring for moving said first spring from said first stable state to said second stable state in response to rotation of said release lever; and c. a contact mechanism including a contact support engaged with said free end of said first spring for establishing a first contact condition when said first spring is in said first stable state and a second contact condition when said first spring is in said second stable state; and d. means for adjusting the force required to cause said first spring to move from said first stable state to said second stable state, wherein said change-over mechanism and said contact mechanism are assembled independently and said change-over mechanism possesses no electrically conductive portion in either said first stable state or said second stable state.

7. A thermal overload relay according to claim 6, wherein said first spring includes a first leg including said free end, a second leg for contacting said release lever, and a opening for enabling said second leg to pass through said first leg upon rotation of said release lever to move said first spring from said first stable state to said second stable state.

8. A thermal overload relay according to claim 7, wherein said second spring includes a first side member having an end attached to said second spring and a second side member having an end attached to said first spring said second spring for biasing said first spring to pass the dead point thereof as said first spring moves from said first stable state to said second stable state.

9. A thermal overload relay according to claim 8, wherein said contact mechanism includes:

a first set of fixed contacts;

a second set of fixed contacts;

a first set of movable contacts mounted on said contact support for contacting said first set of fixed contacts when said first spring is in said first stable state; and a second set of movable contacts mounted on said contact support for contacting said second set of fixed contacts when said first spring is in said second stable state.

10. A thermal overload relay according to claim 9, further including a restoring rod connected to said contact support, said restoring rod when activated for moving said contact support to contact said first set of fixed contacts and said second set of fixed contacts and for moving said first spring from said second stable state to said second stable state.

11. A thermal overload relay according to claim 6, wherein said adjusting means comprises:

a third spring for biasing said first spring into said first stable state; and a set screw mechanism for selectively setting said biasing force of said third spring to enable the selection of the amount of force required to be applied to said second leg of said first spring by said release lever to cause said first spring to move from said first stable state to said second stable state.

* * * * *

UNITED STATES PATENT AND TRADEMARK OFFICE

CERTIFICATE OF CORRECTION

PATENT NO. : 4,908,594

DATED : March 13, 1990

INVENTOR(S) : Katsumi Akiike et al

It is certified that error appears in the above-identified patent and that said Letters Patent is hereby corrected as shown below:

Claim 8, Column 8, Line 2, "spring" (first occurrence) should be followed by --,--.

Signed and Sealed this

Twenty-seventh Day of October, 1992

*Attest:*

DOUGLAS B. COMER

*Attesting Officer*

*Acting Commissioner of Patents and Trademarks*